US011846397B1

(12) United States Patent
Gong

(10) Patent No.: US 11,846,397 B1
(45) Date of Patent: Dec. 19, 2023

(54) STRIP-TYPE LAMP ASSEMBLY

(71) Applicant: HIMA LIGHTING TECHNICAL CO., LTD, Zhongshan (CN)

(72) Inventor: Beiwen Gong, Zhongshan (CN)

(73) Assignee: HIMA LIGHTING TECHNICAL CO., LTD, Zhongshan (CN)

( * ) Notice: Subject to any disclaimer, the term of this patent is extended or adjusted under 35 U.S.C. 154(b) by 0 days.

(21) Appl. No.: 18/302,810

(22) Filed: Apr. 19, 2023

(51) Int. Cl.

| | |
|---|---|
| ***F21S 4/28*** | (2016.01) |
| ***F21V 23/06*** | (2006.01) |
| ***F21V 19/00*** | (2006.01) |
| ***F21S 2/00*** | (2016.01) |
| *F21Y 115/10* | (2016.01) |

(52) U.S. Cl.
CPC ..... *F21S 4/28* (2016.01); *F21S 2/005* (2013.01); *F21V 19/0045* (2013.01); *F21V 23/06* (2013.01); *F21Y 2115/10* (2016.08)

(58) Field of Classification Search
CPC ..... F21V 23/06; F21V 19/0045; F21V 21/34; F21V 21/35; F21S 2/005; F21S 4/28; F21S 8/066; F21S 8/038
See application file for complete search history.

(56) References Cited

U.S. PATENT DOCUMENTS

2016/0018092 A1* 1/2016 Knaapen ..... F21V 23/06 362/249.02

FOREIGN PATENT DOCUMENTS

| | | | | |
|---|---|---|---|---|
| CN | 113309999 A * | 8/2021 | ..... | F21S 8/00 |
| DE | 102018122361 A1 * | 3/2020 | ..... | F21S 2/00 |
| EP | 1300629 A1 * | 4/2003 | ..... | F21S 2/00 |

OTHER PUBLICATIONS

Innovation Q+ NPL Search Aug. 2023 (Year: 2023).*

* cited by examiner

*Primary Examiner* — Anabel Ton
(74) *Attorney, Agent, or Firm* — Andrew C. Cheng

(57) ABSTRACT

The present disclosure provides a strip-type lamp assembly including a plurality of light bars, a plurality of lamps detachably arranged on the plurality of light bars, and a connecting member detachably connected between every two adjacent light bars of the plurality of light bars. The present disclosure not only can flexibly disassemble and assemble the plurality of lamps, but also can assemble various light bars with different lengths and shapes.

9 Claims, 5 Drawing Sheets

STRIP-TYPE LAMP ASSEMBLY

BACKGROUND

1. Technical Field

The present disclosure generally relates to the field of lamps, and especially relates to a strip-type lamp assembly.

2. Description of Related Art

A strip lamp is a new type of auxiliary lamp that a plurality of LEDs or laser lights is usually fixed in a body of the strip lamp, which is called as the strip lamp. However, a conventional strip lamp is usually an integral structure, and when any one of light sources within the strip lamp is damaged, it will cause the whole strip lamp to be affected; at the same time, a length and a shape of the conventional strip lamp are fixed, and the strip lamp is usually fixed at a fixed angle, which will limit applicability thereof.

SUMMARY

The technical problems to be solved: in view of the shortcomings of the related art, the present disclosure provides a strip-type lamp assembly which can not only flexibly disassemble and assemble a plurality of lamps thereon, but also assemble various light bars with different shapes thereon, while the plurality of lamps can be rotated.

An strip-type lamp assembly according to an embodiment of the present disclosure includes: a plurality of light bars, a plurality of lamps detachably arranged on the plurality of light bars, and a connecting member detachably connected between every two adjacent light bars of the plurality of light bars;

Each of the plurality of light bars including a first slide groove extending along an extension direction of the plurality of light bars, and each of the plurality of lamps including a locking slider corresponding to the first slide groove, the plurality of lamps sliding in the first slide groove and fixed with the first slide groove through the locking slider;

The locking block including a first sliding block, a connecting bar and a locknut, the first sliding block arranged on one end of the connecting bar, and a thread formed on the other end of the connecting bar to match with the locknut, the locknut arranged outside the first sliding groove, and each of the plurality of light bars including a recess for allowing the connecting bar to pass therethrough; and wherein A cross-sectional shape of a surface where the recess is located is arc, each of the plurality of lamps including a connecting plate fitted with the surface where the recess is located, and the connecting plate including an arc-shaped rotating recess, the recess perpendicular to a plane where the rotating recess is located, and the one end of the connecting bar passing through the recess and the rotating recess.

Wherein a plurality of first limiting slots is arranged along the extension direction of the plurality of light bars, and a first limiting slide block that matches with the first limiting slot arranged on a surface that the plurality of lamps is attached to the plurality of light bars.

Wherein the first limiting slot is a corrugation-shaped slot.

Wherein the connecting member includes at least two end portions, and any one of the at least two end portions is in contact with at least one surface of the plurality of light bars.

Wherein each of the at least two end portions includes a second limiting slide block matched with the first limiting slot.

Wherein an installing member is arranged on each of the plurality of light bars.

Wherein each of the plurality of light bars includes a second sliding groove, and the installing member slidably received in the second sliding groove.

Wherein each of the plurality of lamps includes an LED lamp and a laser light.

Wherein a curvature of the surface where the recess is located is greater than a curvature of the connecting plate.

Wherein an independent control circuit board is arranged on each of the plurality of lamps.

Compared with the related art, the present disclosure provides the advantages as below:

The present disclosure can assemble the strip-type lamp more convenient by setting the plurality of detachable lamps on the light bar, and assemble different lamps according to actual needs, which can have a high flexibility and be applied to various different environments; a length and a shape of the light bar can be more variable to be widely used by setting the detachable connecting member; the lamp can rotate at a certain angle during sliding on the light bar so that the strip-type lamp can be used more flexibly and variably by setting the surface where the recess is located, the curved connecting plate and the locknut.

Figure 1:
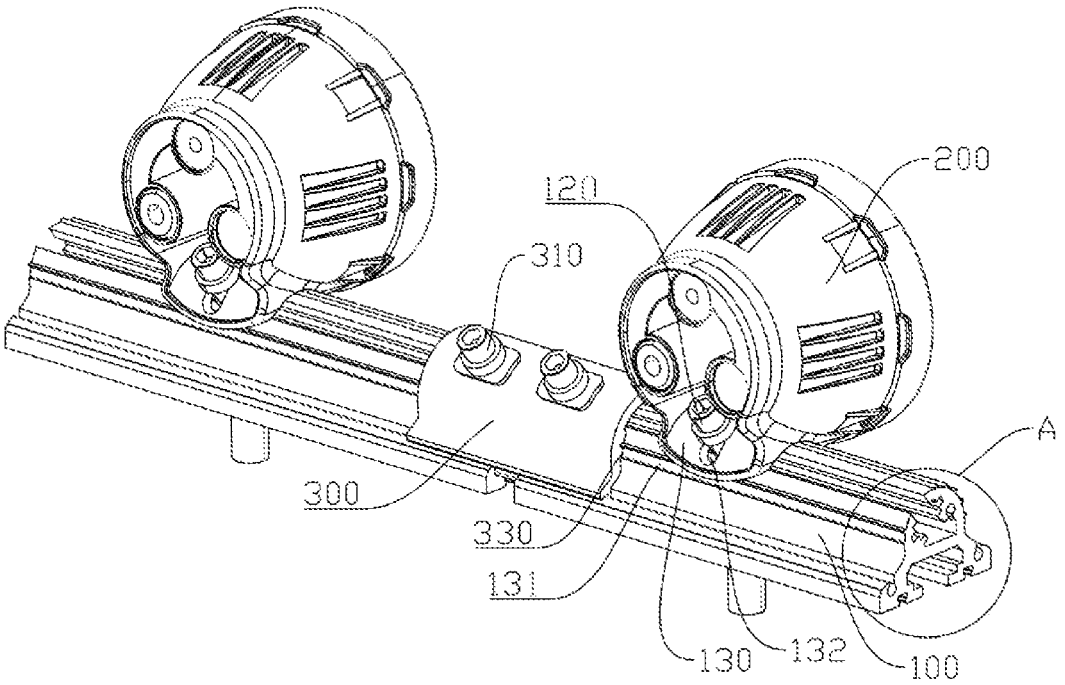
FIG. 1 is a schematic view of a strip-type lamp assembly in accordance with an embodiment of the present disclosure.
Figure 2:
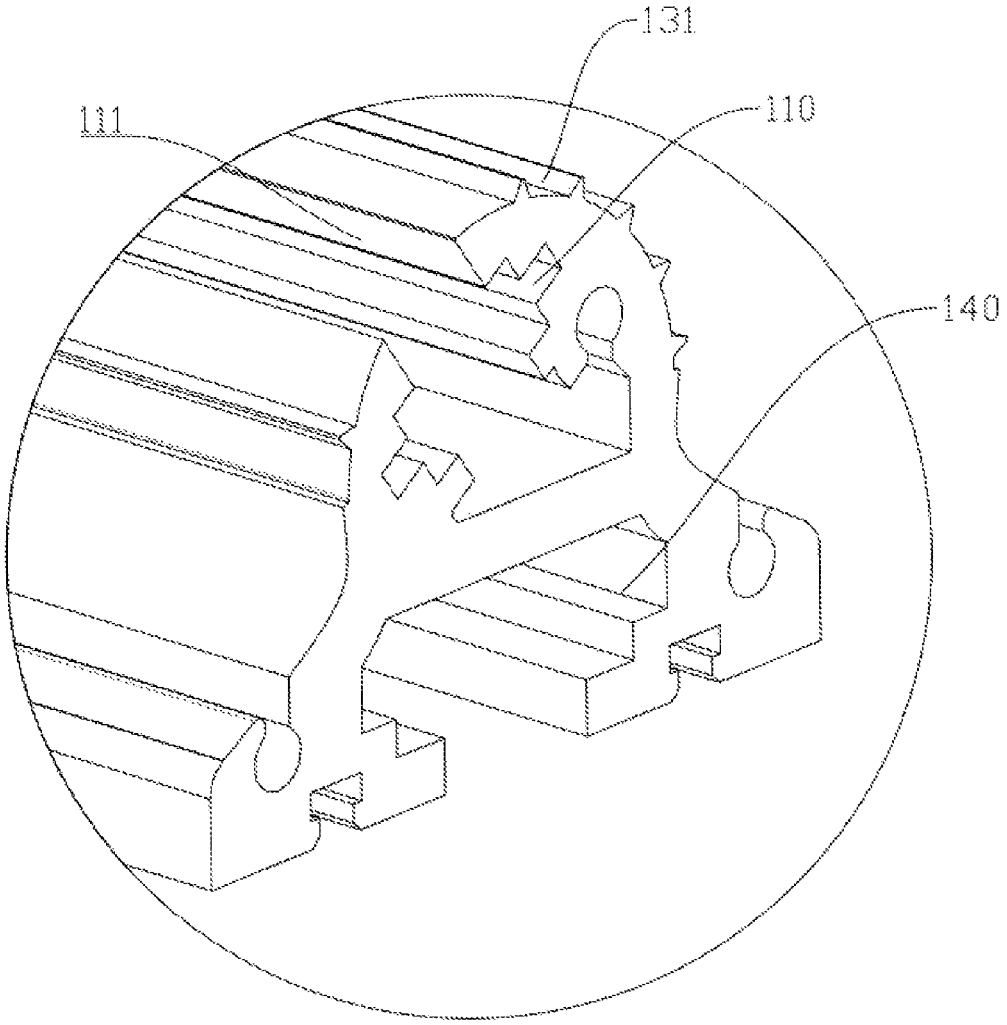
FIG. 2 is a schematic view of a part A of the strip-type lamp assembly of FIG. 1.

The element labels according to the embodiment of the present disclosure shown as below:

100 light bar, 200 lamp, 300 connecting member, 110 first slide groove, 111 recess, 120 locking slider, 121 first sliding block, 122 connecting bar, 123 locknut, 130 connecting plate, 131 first limiting slot, 132 rotating recess, 133 first limiting slide block, 140 second sliding groove, 150 installing member, 151 first bolt, 152 first nut, 310 second bolt, 320 end portion, 330 second limiting slide block.

DETAILED DESCRIPTION

Reference will now be made in detail to embodiments, examples of which are illustrated in the accompanying drawings. Obviously, the implementation embodiment in the description is a part of the present disclosure implementation examples, rather than the implementation of all embodiments, examples.

In the description of the present disclosure, it should be pointed out that terms “up”, “down”, “inside”, etc. indicate an orientation or a position relationship based on the orientation or position relationship shown in the accompanying drawings, only for the purpose of conveniently describing the present disclosure and simplifying the description, rather than indicating or implying that a device or an element referred to must have a specific orientation, be constructed and operated in a specific orientation, which can't be intended to limit the present disclosure.

Referring to FIGS. 1-5, a strip-type lamp assembly in accordance with an embodiment of the present disclosure includes: a plurality of light bars 100, a plurality of lamps 200 detachably arranged on the plurality of light bars 100, and a connecting member 300 detachably connected between every two adjacent light bars 100 of the plurality of light bars 100.

Specifically, in an embodiment of the present disclosure, the light bar 100 is a long strip structure, and a row of lamps 200 can be set on a side of the plurality of light bars 100. Specific shapes and sizes of the plurality of lamps 200 can be set according to actual requirements.

In an embodiment of the present disclosure, the plurality of lamps 200 is detachably installed on the plurality of light bars 100, and there are many methods for detachably setting the plurality of lamps 200, such as by buckles and bolts, which can be applied to the embodiment of the present disclosure. The detachable setting method is applied for installing the plurality of lamps 200 more flexibly during actual using the strip-type lamp assembly, and the plurality of lamps 200 with different specifications can be assembled according to actual requirements. For example, for some conventional environments, conventional LED lamps can be used. In some environments with high brightness requirements, laser lamps can be used; while in other environments, colored lamps such as blue lamps, red lamps, and green lamps can also be used. These lamps are common lamps 200 in this field, so specific structures of the common lamps will not be reported. Due to the integral structure of the conventional strip-type lamps, when any light source within the lamp 200 is damaged, an overall effect of the lamp 200 will be affected, which is difficult to apply to a plurality of different environments at the same time. In the embodiment of the present disclosure, when one of the plurality of lamps 200 is damaged, the lamp 200 that has been damaged can be directly removed and replaced with other lamps 200; in addition, the strip-type lamp assembly can be adapted for being used in different environments by replacing different lamps 200, which has more extensive application ranges.

Furthermore, it is clear to those skilled in the art that for the plurality of lamps 200 in the embodiment of the present disclosure, either the same control circuit board or a separate control circuit board can be used for controlling the plurality of lamps 200; however, based on characteristics of the strip-type lamp assembly in the embodiment of the present disclosure, it is preferred to use the separate control circuit board to control the plurality of lamps 200. When one of the plurality of lamps 200 is damaged, it is only necessary to disassemble the lamp 200 that has been damaged to replace with a new lamp 200, which will not affect a normal operation of the other lamps 200. At the same time, for the plurality of lamps 200, some lamps 200 have their own batteries, while some lamps 200 require external power supplies, so, in order to meet the lamps 200 with external power supplies, a wire slot is arrange on the light bar 100, so that wires between the lamp 200 and the external power supply can be set in the wire slot, result in making the entire strip-type lamp assembly more concise.

Figure 5:
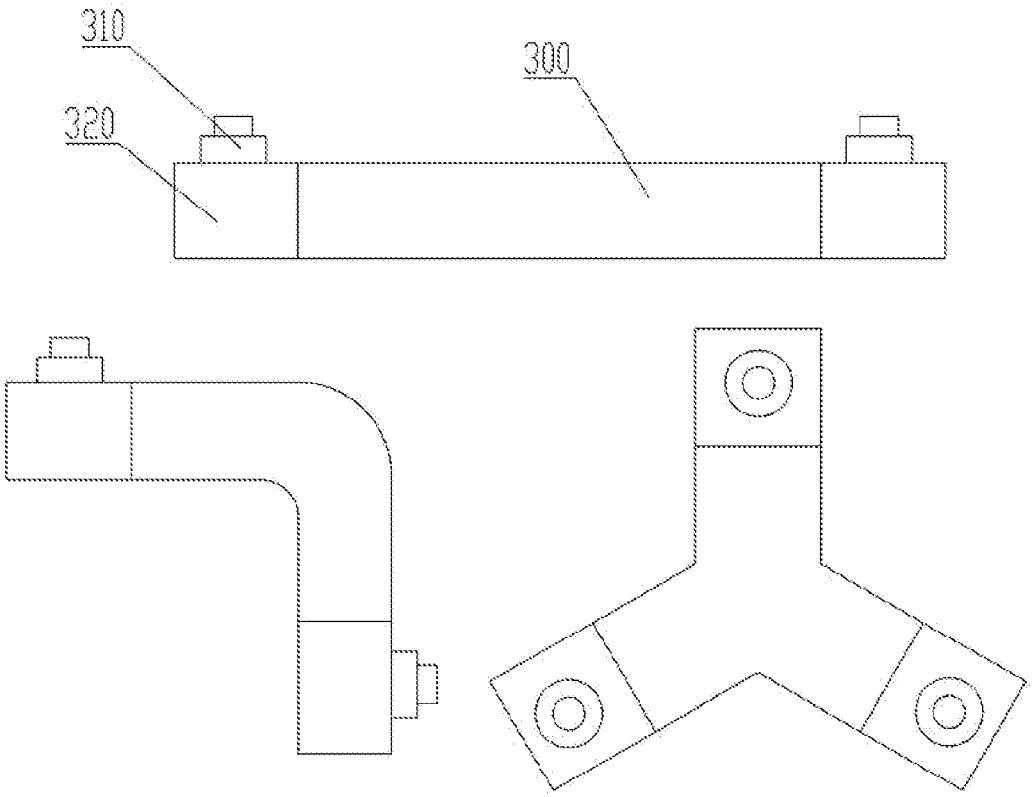
FIG. 5 is a schematic view of a connecting member of the strip-type lamp assembly of FIG. 1.

Meanwhile, the connecting member 300 is provided to connect two light bars 100. Referring to FIG. 5, in order to make a shape of the entire strip-type lamp assembly more diverse, the connecting member 300 can be arranged in shapes such as a straight-line shape, a broken-line shape, a three-way pipe shape, etc., so that final shapes of the strip-type lamp assembly can present various different shapes. However, both end portions of any connecting member 300 need to be detachably connected to the light bar 100. In this field, there are various detachable connection methods, such as bolt connections, buckle connections, etc., which belong to conventional connection methods in this field and can be applied to embodiments of the present disclosure.

Referring to FIG. 1 to FIG. 4, in order to provide more diversified settings for the plurality of lamps 200 on the light bar 100, in some embodiments, the light bar 100 includes a first slide groove 110 and the lamp 200 includes a locking slider 120 corresponding to the first slide groove 110, so that the lamp 200 is detachably connected to the light bar 100 by sliding the locking slider 120 in the first slide groove 110. The first slide groove 110 is arranged along an extension direction of the light bar 100 and adopts to be a conventional slide groove that can prevent the locking slider from moving along a non-sliding direction of the slide groove, such as a T-shaped groove that is commonly used. A cross-section of the T-shaped groove is T-shaped, and both ends of the locking slider are limited by the T-shaped groove, so that the locking slider can only slide along the extension direction of the T-shaped groove. In the embodiment of the present disclosure, the first slide groove 110 is a T-shaped groove.

The so-called "extension direction" of the light bar 100 refers to the light bar 100 is elongated, so that the light bar 100 extends from one end of the light bar 100 to the other end of the light bar 100, to form such extension direction thereof. For example, the extension direction of a straight light bar 100 is from one end to the other end thereof to form a straight line; while, the extension direction of a curved light bar 100 is also from one end to the other end thereof to form a curved line with the same radian as that of the light bar 100.

Meanwhile, the locking slider 120 not only slides within the first slide groove 110, but also is provided to lock the lamp 200 onto the light bar 100. Therefore, in the embodiment of the present disclosure, a new locking slider 120 is provided.

The locking slider 120 includes a first sliding block 121, a connecting bar 122 and a locknut 123. One end of the connecting bar 122 is connected to the first sliding block 121, and the other end of the connecting bar 122 is arranged outside the first slide groove 110 and includes a thread to match with the locknut 123. The first sliding block 121 is engaged with the first slider groove 110 and slides within the first slider groove 110. A section of the connecting bar 122 that is not threaded can be circular or square, which can be set according to actual situations. Those skilled in the art can be understood that in order to fully utilize the function of the locking slider 120, a corresponding connecting plate 130 is also provided on the lamp 200. One end of the connecting bar 122 passes through the connecting plate 130. Through the locknut 123 and the connecting plate 130, the lamp 200 can slide on the first slide groove 110 when the locknut 123 is not tightened. When the locknut 123 is tightened, the lamp 200 is fixed with the light bar 100. At the same time, the connecting plate 130 can be integrated with the lamp 200 or set separately from the lamp 200. In the embodiment of the present disclosure, the connecting plate 130 and the lamp 200 can be integrated to each other for conveniently manufacturing the strip-type lamp assembly.

By the locking slider 120 mentioned above, the lamp 200 can be fixed at any position of the first slide groove 110, so that a layout of the lamp 200 on the light bar 100 can be conveniently adjusted, so as to make the strip-type lamp assembly of the present disclosure be suitable for various different environments. However, in some cases, after installing the strip-type lamp assembly, the lamp 200 is fixed at a fixed angle, resulting in limited applicability.

In some embodiments, a cross-sectional shape of a surface where a recess 111 is located is defined as an arc shape; at the same time, the connecting plate 130 that is in line with the surface of the recess 11*l* is installed on the lamp 200, and an arc-shaped rotating recess 132 is arranged on the connecting plate 130. The recess 111 is perpendicular to a plane of the rotating recess 132, and one end of the connecting bar 122 passes through the recess 111 and the rotating recess 132.

The cross-section of the surface where the recess 111 is located to be arc and the connecting plate 130 is provided to fit with the surface where the recess 111 is located, so that the connecting plate 130 can rotate on the surface where the recess 111 is located, and when the connecting plate 130 rotates at a certain angle, the connecting plate 130 still fits with the surface where the recess 111 is located. Of course, to obtain such a function, a curvature of a curved surface of the connecting plate 130 needs to be smaller than a curvature of the surface where the recess 111 is located. The greater a difference between the curvature of the curved surface of the connecting plate 130, and the curvature of the surface where the recess 111 is located, the greater an angle at which the connecting plate 130 can rotate. However, when the difference is too large, it will cause the locking slider 120 to be unable to tighten the lamp 200. Therefore, it is required that the curvature of the curved surface of the connecting plate 130 is not less than half of the curvature of the surface where the recess 111 is located. Preferably, the curvature of the curved surface of the connecting plate 130 is not less than three-fifths of the curvature of the surface where the recess 111 is located. Similarly, a curvature of the rotating recess 132 is not too large. Since the rotating recess 132 is set on the connecting plate 130, the curvature of the rotating recess 132 should not be greater than that of the curved surface of the connecting plate 130.

Furthermore, due to provide the arc-shaped rotating recess 132, when the connecting plate 130 rotates around its own arc-shaped axis, the connecting plate 130 drives the lamp 200 to rotate. However, due to the rotating recess 132, the locking slider 120 can still fix the connecting plate 130.

Specifically, although theoretically speaking, the above setting can enable the lamp 200 to rotate at a certain angle on the light bar 100, those skilled in the art can know from the structure of the strip-type lamp assembly of the present disclosure that in most cases, stability of the lamp 200 that has been locked is relatively poor. In order to solve the above problem, in the embodiment of the present disclosure, a plurality of first limiting slots 131 is arranged on the light bar 100. Correspondingly, a plurality of first limiting slide blocks 133 corresponding to the plurality of first limiting slots 131 is provided on a surface of the lamp 200 that is attached to the light bar 100. The first limiting slot 131 can be set as a groove or as a conventional groove such as a T-shaped groove. At the same time, a size of the first limiting slot 131 does not need to be large, and a depth of the first limiting slot 131 is not less than 1 mm. Meanwhile, the first limiting slot 131 is set along the extension direction of the light bar 100, that is, the first limiting slot 131 and the first slide groove 110 are parallel to each other. Preferably, the first limiting slot 131 is a corrugation-shaped slot, which refers to a groove structure with a wavy cross-section.

Figure 3:
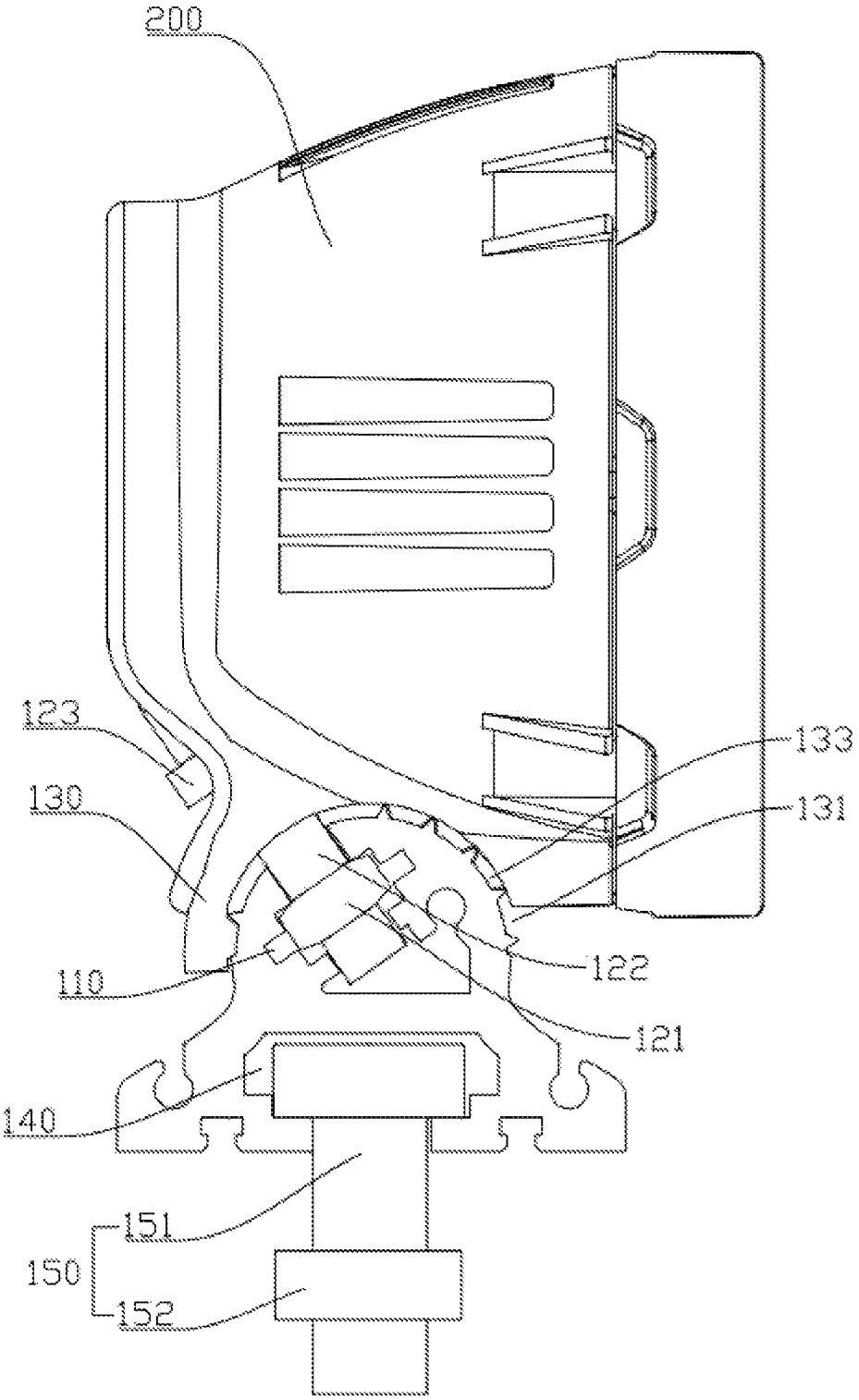
FIG. 3 is a side view of the strip-type lamp assembly of FIG. 1.
Figure 4:
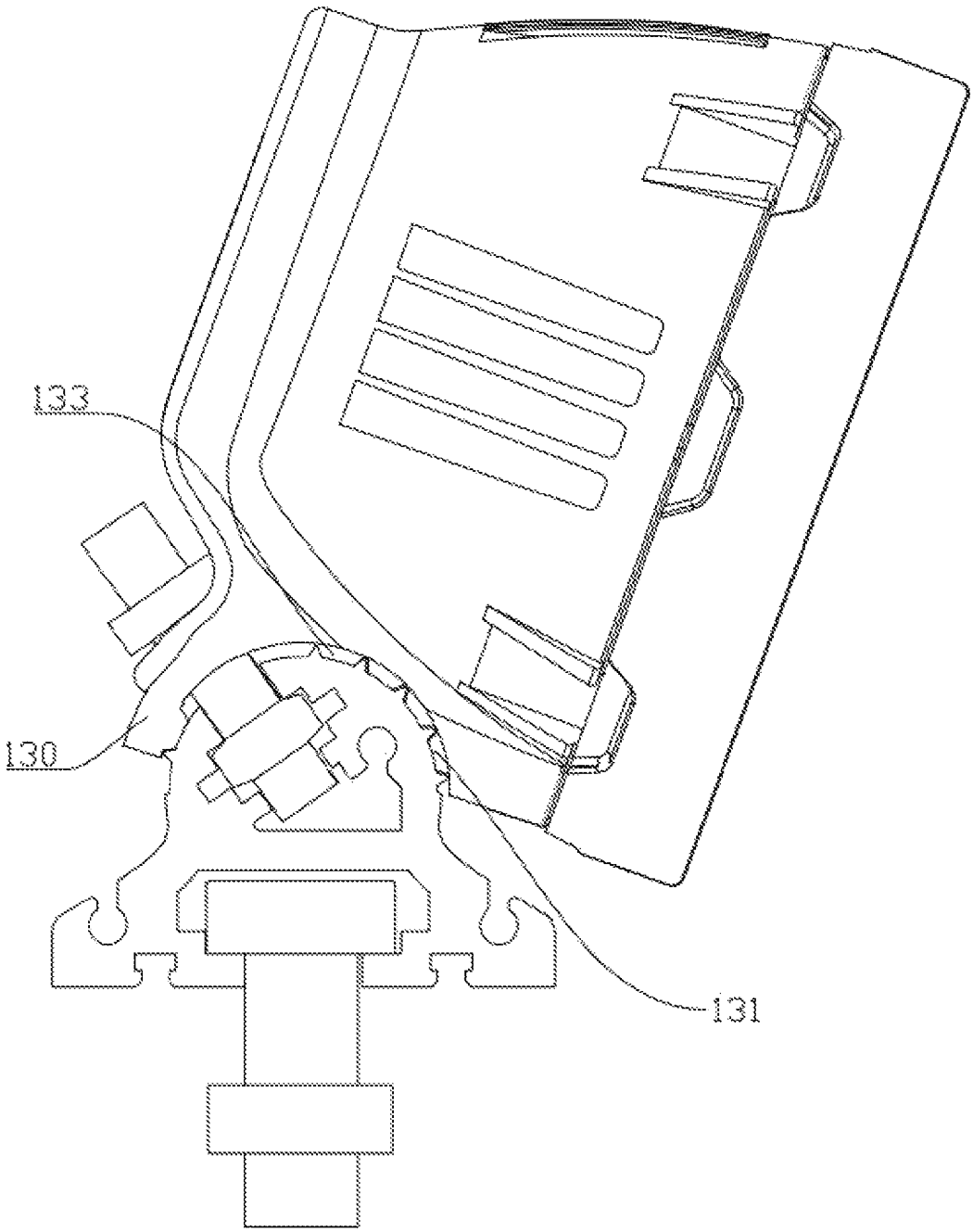
FIG. 4 is similar to FIG. 3, but shown after changing an angle of the lamp thereof.

The first limiting slot 131 and the first limiting slide block 133 can be together with the locknut 123 to fix the lamp 200 on the light bar 100 more stable; meanwhile, the lamp 200 can move on the light bar 100 more stable under the action of the first limiting slot 131 and the first limiting slide block 133. Referring to FIG. 3 and FIG. 4, schematic views of the lamp 200 before and after rotation are shown.

In some embodiments, in order to conveniently install the strip-type lamp assembly on other devices (such as cars, etc.), an installing member 150 is also provided on the light bar 100. Depending on the size of the light bar 100, there can be one or more installing members 150. The installing member 150 is a component that connects the light bar 100 with other devices, which can be a conventional installing member 150, such as bolts, nuts, clips, etc. In response to high requirements for installation positions of commonly used installing member 150 in the conventional technology, the embodiment of the present disclosure provides a new installing member 150: a second sliding groove 140 is arranged on one side of the light bar 100, and at least one first bolt 151 that can only slide inside the second sliding groove 140 slides inside the second sliding groove 140, a head of the first bolt 151 slides inside the second sliding groove 140, a thread is arranged at one end of the first bolt 151 away from the second sliding groove 140, and a first nut 152 that matches with the thread is also provided. Through the first bolt 151 and the second sliding groove 140, the installing member 150 can be adjusted according to an actual installation position, result in installing the entire strip-type lamp assembly more flexible.

The connecting member 300 includes at least two end portions 320, and each of the two end portions 320 attaches to at least one surface of the light bar 100. Although theoretically, the connecting member 300 can still detachably connect with the light bar 100 even though the connecting member 300 is not attached to the surface of the light bar 100, but from a practical use perspective, this non-attachment setting makes an overall space of the light bar 100 occupy a large space and has high requirements for the installation environments. Therefore, the end portion 320 of the connecting member 300 is attached to the surface of the light bar 100, which can save a space thereof.

In order to make the connecting member 300 more convenient for connecting two light bars 100, there are two through-holes arranged on the connecting member 300, and two second bolts 310 passing through the through-holes are also provided. A head of the second bolt 310 is located inside the first limiting slot 131, and a second screw rod of the second bolt 310 passes through the first limiting slot 131 and the through-hole. A second nut is also provided on the second screw rod to fix the connecting member 300 and the light bar 100. At the same time, in order to further increase the connection stability between the connecting member 300 and the light bar 100, a second limiting slide block 330 corresponding to the first limiting slot 131 is arranged on the surface where the end portion 320 is attached to the light bar 100. By using the first limiting slot 131 and the second limiting slide block 330, the connection between the connecting member 300 and the light bar 100 is more stable.

It is can be understood for those skilled in the art that a length of the first limiting slot 131 of the embodiment of the present disclosure, can be the same as a length of the light bar 100, or can be slightly shorter than the length of the light bar 100. However, from an actual usage situation, when the length of the first limiting slot 131 is the same as the length of the light bar 100, it is more convenient to install the lamp 200 and the connecting member 300.

Meanwhile, those skilled in the art can understand that the size of lamp 200 can be set according to actual situations. Although the size of the lamp 200 in the figures of the embodiment of the present disclosure is small, in other embodiments of the present disclosure, the size of the lamp 200 can be designed to be large.

When the strip-type lamp assembly is used, the lamps with different shapes and styles can be installed on the light bar according to actual needs. When the lamp moves to a target position of the light bar, the connecting plate of the lamp rotates to present the lamp at a desired angle, and then the lamp is fixed by the locking slider; the same method can be used to fix the plurality of lamps on the light bar.

Subsequently, according to actual needs, the plurality of light bars that has been assembled are connected by the connecting members with different shapes, such as linear connecting members, arc connecting members, and three-way pipe connecting members, so as to ultimately obtain strip-type lamp assemblies with different styles.

Finally, the strip-type lamp assembly can be fixed by the connecting member.

When one of the plurality of lamps on the light bar is damaged or needs to be replaced according to actual needs, the lamp that has been damaged or needs to be replaced can be removed by opening the locknut, and then replaced.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. A strip-type lamp assembly comprising:

a plurality of light bars, a plurality of lamps detachably arranged on the plurality of light bars, and a connecting member detachably connected between every two adjacent light bars of the plurality of light bars, any one of the plurality of lamps is electrically connected to a power source, the power source comprises a battery and an external power supply;

each of the plurality of light bars comprising a first slide groove extending along an extension direction of the plurality of light bars, and each of the plurality of lamps comprising a locking slider corresponding to the first slide groove, the plurality of lamps sliding in the first slide groove and fixed with the first slide groove through the locking slider;

the locking block comprising a first sliding block, a connecting bar and a locknut, the first sliding block arranged on one end of the connecting bar, and a thread formed on the other end of the connecting bar to match with the locknut, the locknut arranged outside the first sliding groove, and each of the plurality of light bars comprising a recess for allowing the connecting bar to pass therethrough; and wherein a cross-sectional shape of a surface where the recess is located is arc, the plurality of lamps comprising a connecting plate fitted with the surface where the recess is located, and the connecting plate comprising an arc-shaped rotating recess, the recess perpendicular to a plane where the rotating recess is located, and the one end of the connecting bar passing through the recess and the rotating recess.

2. The strip-type lamp assembly as claimed in claim 1, wherein a plurality of first limiting slots is arranged along the extension direction of the plurality of light bars, and a first limiting slide block that matches with the first limiting slot arranged on a surface that the plurality of lamps is attached to the plurality of light bars.

3. The strip-type lamp assembly as claimed in claim 2, wherein the first limiting slot is a corrugation-shaped slot.

4. The strip-type lamp assembly as claimed in claim 2, wherein the connecting member comprises at least two end portions, and any one of the at least two end portions is in contact with at least one surface of the plurality of light bars.

5. The strip-type lamp assembly as claimed in claim 4, wherein each of the at least two end portions comprises a second limiting slide block matched with the first limiting slot.

6. The strip-type lamp assembly as claimed in claim 1, wherein an installing member is arranged on each of the plurality of light bars.

7. The strip-type lamp assembly as claimed in claim 6, wherein each of the plurality of light bars comprises a second sliding groove, and the installing member slidably received in the second sliding groove.

8. The strip-type lamp assembly as claimed in claim 1, wherein each of the plurality of lamps comprises an LED lamp and a laser light.

9. The strip-type lamp assembly as claimed in claim 1, wherein a curvature of the surface where the recess is located is greater than a curvature of the connecting plate.

* * * * *